United States Patent [19]

Dowling et al.

[11] Patent Number: 4,576,231

[45] Date of Patent: Mar. 18, 1986

[54] METHOD AND APPARATUS FOR COMBATING ENCROACHMENT BY IN SITU TREATED FORMATIONS

[75] Inventors: Donald J. Dowling, Houston; Harold A. Palmer, Nacogdoches, both of Tex.

[73] Assignee: Texaco Inc., White Plains, N.Y.

[21] Appl. No.: 650,140

[22] Filed: Sep. 13, 1984

[51] Int. Cl.[4] ..... E21B 37/02; E21B 36/04; E21B 43/24

[52] U.S. Cl. ..... 166/248; 166/60; 166/104; 166/173; 166/311; 166/65.1

[58] Field of Search ..... 166/60, 65 R, 104, 173, 166/177, 248, 301, 302, 311; 219/10.55 D, 10.65, 10.81

[56] References Cited

U.S. PATENT DOCUMENTS

| | | | |
|---|---|---|---|
| 2,757,738 | 8/1956 | Ritchey | 166/248 |
| 3,152,642 | 10/1964 | Bodine, Jr. | 166/177 X |
| 3,199,599 | 8/1965 | Kammerer, Jr. | 166/173 |
| 4,140,179 | 2/1979 | Kasevich et al. | 166/60 X |
| 4,396,062 | 8/1983 | Iskander | 166/248 |
| 4,398,597 | 8/1983 | Haberman | 166/248 X |
| 4,476,926 | 10/1984 | Bridges et al. | 166/248 |
| 4,508,168 | 4/1985 | Heeren | 166/248 |

*Primary Examiner*—George A. Suchfield

*Attorney, Agent, or Firm*—Robert A. Kulason; James J. O'Loughlin; Henry C. Dearborn

[57] ABSTRACT

A method and apparatus is applicable to in situ heating of oil shale or tar sand. The heating is by radio frequency that is applied down hole by a central conductor that extends beyond a coaxial shielding conductor to form the antenna or applicator. Encroachment by the heated formation is overcome by applying motion to the central conductor to remove encroaching formations.

12 Claims, 8 Drawing Figures

METHOD AND APPARATUS FOR COMBATING ENCROACHMENT BY IN SITU TREATED FORMATIONS

This invention concerns in situ heating of hydrocarbon bearing earth formations, in general. More specifically it concerns a method and apparatus for overcoming formation expansion down hole, and particularly that due to radio frequency heating of the formation.

Although the use of radio frequency heating down hole has been proven effective, a problem has been encountered. Thus, as the subsurface formation is heated in order to remove the petroleum that is locked into tar sands or oil shales or the like, the heating creates a swelling of the formation which can render the radio frequency antenna structure ineffective.

In other words, in connection with radio frequency heating down hole, as the formation temperature is raised the kerogen begins a chemical transformation to form a petroleum mist which is removed from the well bore using various techniques. During such procedure, as heat is being absorbed and as the chemical conversion begins, the earth formation is subjected to expansive forces which fracture and expand the rock masses toward any region of reduced overburden pressure. Such a reduced pressure region exists in the well bore and accordingly as the rock heats and expands the earth material invades the borehole. Furthermore, because it is at the antenna structure (of the radio frequency heater) that the heating effect is the greatest, the invasion will result in a serious loss of desired electromagnetic energy into the formation. And, it may intrude close enough to having arcing occur. Heretofore, known attempts to combat the forces of swelling at the formation have been quite unsatisfactory, and/or at the least very expensive and difficult. One example of such prior attempts is U.S. Pat. No. 4,398,587 issued Aug. 16, 1983. That patent makes use of an inflatable cover that encompasses the antenna and is inflated with sufficient pressure to withstand the tendancy to invade the borehole.

It is an object of this invention to provide a method and apparatus for combating an encroachment by the heated formation in an in situ radio frequency heating procedure. It acts to remove the expanded formation and thus control the electromagnetic characteristics of the well bore at the surrounding medium of the antenna.

BRIEF SUMMARY OF THE INVENTION

The invention is in radio frequency heating of oil shale or tar sand formations in situ wherein a central conductor and a coaxial shield are employed down hole. It is a method of combating the encroachment of said heated formation, which comprises applying realtive motion to said central conductor periodically for removing said encroaching formation.

Again briefly, the invention is in radio frequency heating of oil shale or tar sand formations in situ. It is in combination with an applicator for electromagnetic propagation of radio frequency energy into said formation. The said applicator comprises a central conductor extending a predetermined distance beyond the end of a coaxial shielding conductor, and a radio frequency generator for supplying said radio frequency energy to said applicator. The improvement comprises means associated with said central conductor for moving it relative to said formation whereby encroachment by said formation may be prevented.

Once more briefly, the invention is in radio frequency heating of oil shale or tar sand formations in situ. It is in combination with an applicator for electromagnetic propagation of radio frequency energy into said formation. The said applicator comprises a central steel pipe, extending a predetermined distance beyond the end of a concentric steel pipe shielding conductor. The combination also comprises a radio frequency generator connected to said central steel pipe and to said concentric steel pipe for supplying said radio frequency to said applicator. The improvement comprises first annular electrically insulating means attached to said concentric steel conductor, and second annular means integrally attached to said central steel pipe. It also comprises hydraulic cylinder and piston means interconnecting said first and second annular means for moving said central steel pipe vertically relative to said concentric steel pipe.

BRIEF DESCRIPTION OF THE DRAWINGS

The foregoing and other objects and benefits of the invention will be more fully set forth below in connection with the best mode contemplated by the inventors of carrying out the invention, and in connection with which there are illustrations provided in the drawings, wherein.

DETAILED DESCRIPTION

Figure 1:
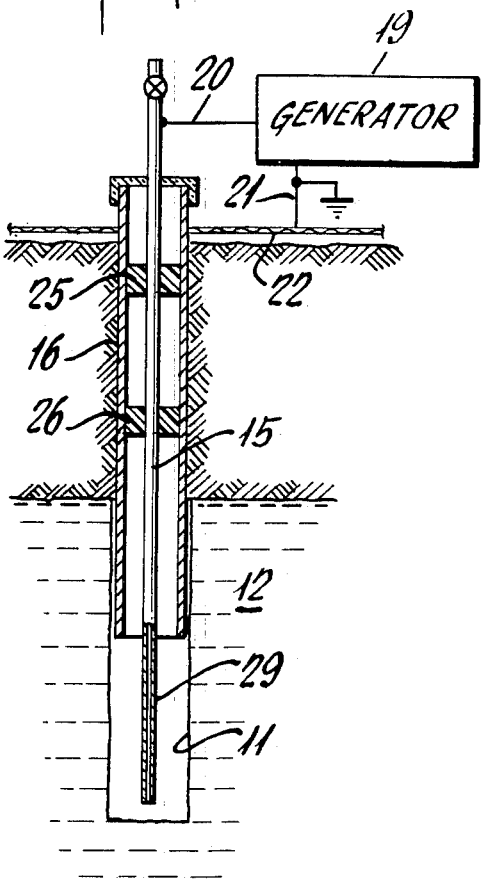
FIG. 1 is a schematic illustration of a radio frequency in situ heating system, showing a generator connected to the central conductor and a coaxial shielding conductor that extends down adjacent to the formation to be heated.

There have been extensive theoretical studies which are supported by much experimental work in connection with a method of heat transfer to down hole formations that is carried out by electromagnetic propagation at radio frequencies. An example is illustrated in FIG. 1, which is a highly simplified schematic diagram showing the basic elements of equipment for carrying out such radio frequency heating in situ. The procedure involves a bore hole 11 that extends into a tar sand or oil shale formation 12. In order to apply the radio frequency energy down hole at the formation 12, there is a central conductor or pipe 15, which is coaxial with an outer casing or shield pipe 16. Pipe 16 acts as a coaxial shield for the electromagnetic radio frequency energy being applied. At the surface, there is generator 19 which applies relatively high powered radio frequency energy to the central conductor pipe 15. It goes via a circuit connection 20, and the circuit to the coaxial shield (conductor pipe) 16 goes via a circuit connection 21 that is grounded. There is good electrical connection to the pipe 16 (as schematically indicated) by a conductor 22. It will be understood that the central conductor 15 is insulated from the coaxial shield or outer conductor pipe 16, by insulating packers or similar supports 25 and 26. It may be noted that the structure provides an applicator for the electromagnetic propagation of radio frequency energy. That applicator or antenna acts to heat the formation 12 at a location which is determined by the applicator's location down hole. Such an applicator may be described also as an antenna for the radio frequency energy propagation. It is made up of a central conductor portion 29 of the central conductor 15. Portion 29 extends a predetermined distance beyond the end of the coaxial shield 16.

Figure 2:
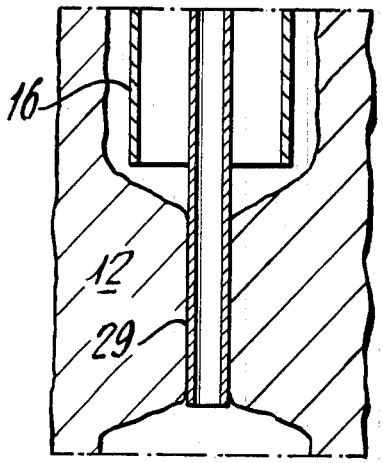
FIG. 2 is a fragmentary schematic illustration indicating the action of formation swelling, which takes place under the effect of the radio frequency heating.

As formation temperature is raised by the heating effect of radio frequency energy application, the kerogen which is locked into the formation begins a chemical transformation. Such transformation forms a petroleum mist that is flushed from the well bore. During the process, as heat is being absorbed and the chemical conversion begins in situ, the earth formation is subjected to expansive forces which fracture and expand the rock masses toward the bore hole 11. As the heating continues the rock will eventually approach and may engage the applicator's central conductor 29. This condition is schematically illustrated in FIG. 2. As it occurs, the applicator (i.e. antenna) of the radio frequency heating apparatus begins to "see" a radically different electromagnetic medium than before the heating is commenced. This results in serious loss of electromagnetic energy into the formation. Often the swelling and approaching of the formation will be accompanied by high voltage standing wave ratios and reflected radio frequency power. Furthermore if the rock intrudes close enough to the unshielded portion (extension 29) of the central conductor, it will cause arcing between the central conductor 29 and the formation 12. Any or all of the foregoing conditions will preclude efficient transfer of the radio frequency energy to the formation for creating the desired heating.

Figure 3:
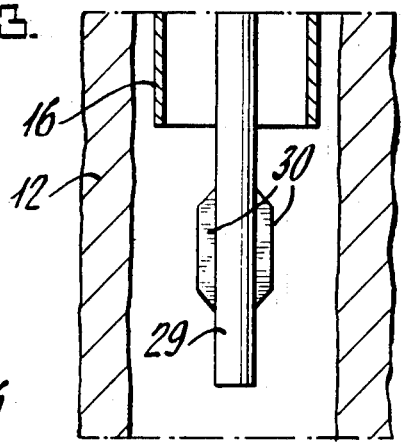
FIG. 3 is a fragmentary schematic illustration showing one form of apparatus which may be used in connection with the central conductor, as a method and/or apparatus of the invention is employed.
Figure 4:
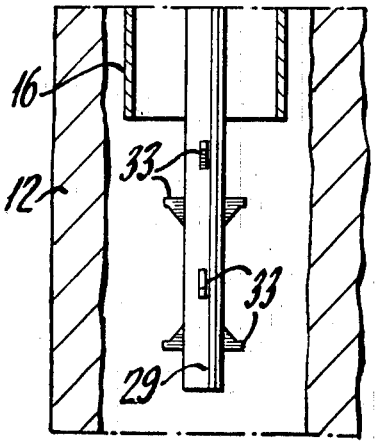
FIG. 4 is another schematic fragmentary illustration like FIG. 3, illustrating a different form of apparatus attached to the central conductor for the same purpose as the FIG. 3 showing.

The invention deals with the foregoing described problem by applying relative motion to the central conductor 29 in order to periodically remove the encroaching formation 12. FIG. 3 illustrates structure which may be used in order to make that action more effective. Thus, the central conductor 29 may be modified by having steel protuberances or bumpers 30, mounted externally on the conductor 29. Consequently, when vertical movement is applied to the conductor 29 the formation will be mechanically removed by breaking it away as vertical movement of the central conductor takes place. It may be noted that the bumper structure 30 might be replaced by chisels 33 that are illustrated in FIG. 4. It will be understood that such chisels might be made retractable and could be surface activated (not shown). Also, the chisels 33 could be made so as to extend centrifugally (not shown) under sufficient speed of rotation of conductor 15.

It will be understood that as oscillation or rotation or other movement of the central conductor 15 and its antenna portion 29 (with the bumpers 30 and/or chisels 33) takes place down hole, arcing of the radio frequency energy would occur briefly as the formation is contacted in dislodging the intruding rock. But thereafter, the heating would resume. It may be noted that the radio frequency heating equipment is provided with self protection circuits (not shown). Such protection circuits would momentarily function. Then following the removal of intruding formation, the full radio frequency heating power would be restored.

Figure 5:
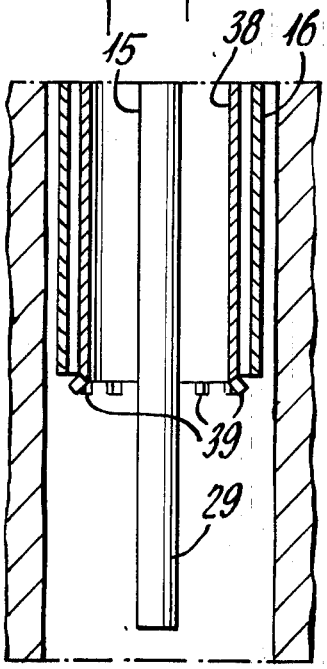
FIG. 5 is a schematic fragmentary of a different form of apparatus which may be employed in carrying out the invention.
Figure 6:
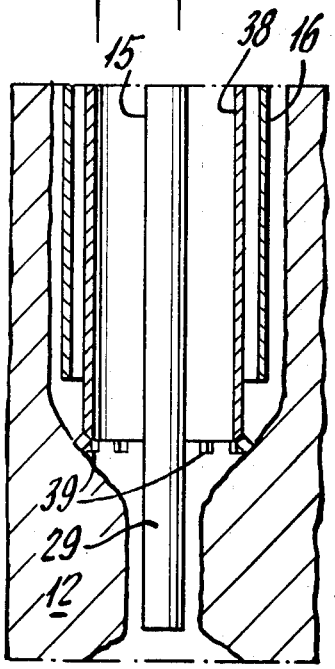
FIG. 6 is a schematic showing of the apparatus illustrated in FIG. 5, as it is used to remove swollen formation which has invaded the bore hole.

FIGS. 5 and 6 illustrate another manner of removing intruding formations. This makes use of a third coaxial pipe 38, which is stored inside the coaxial shielding pipe 16. In this manner it does not interfere with the radio frequency propagation during the heating procedure. Then, as the formation has swollen and intruded into the heating operation (adjacent central conductor 29) the pipe 38 may be lowered as indicated in the FIG. 6 illustration so that it may be rotated and/or vibrated or both in order to cut the intruding formation 12 away and clear the borehole. It will be appreciated that in connection with this procedure the pipe 38 may be equipped with teeth 39 or similar structure at the bottom edge thereof.

Figure 7:
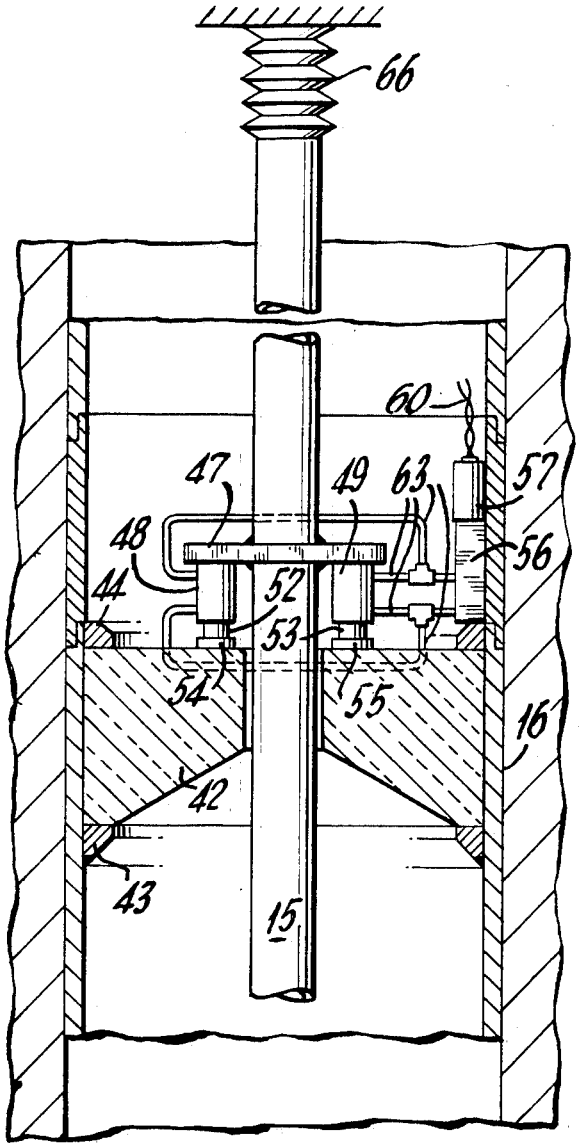
FIG. 7 is a schematic enlarged illustration of apparatus which may be employed in creating vertical oscillatory movement of the central conductor.

FIG. 7 illustrates one form of apparatus which may be employed to provide vertical movement or oscillation of the central conductor pipe 15. There is an annular electrically insulating member 42 that is attached to the coaxial shield pipe 16 by support rings 43 and 44. Rings 43 and 44 are located beneath and above the member 42 respectively. They are welded to the coaxial shield (pipe) 16 on the inside thereof, and this securely attaches the insulating member 42 to the pipe 16.

There is an annular steel ring 47 that is welded onto the central conductor pipe 15, and the ring 47 has hydraulic cylinders 48 and 49 welded on to it. There are pistons 52 and 53 that act in conjunction with the hydraulic cylinders 48 and 49 respectively. The pistons have shoes 54 and 55 respectively that contact the upper surface of the insulating member 42.

In order to actuate the hydraulic cylinders 48 and 49 there is a hydraulic pump 56 that is actuated by an electric motor 57. Electric power is supplied by a pair of wires 60 that extend to the surface. Flexible hoses 63 connect the hydraulic pump 56 to the cylinders 48 and 49 for actuating the pistons 52 and 53 in order to create vertical movement or oscillation of the central conductor pipe 15 relative to the coaxial shield pipe 16. It will be appreciated that a bellows or spring member 66 is needed in connection with the central conductor pipe 15 in order to permit the desired vertical movement of the pipe 15.

Figure 8:
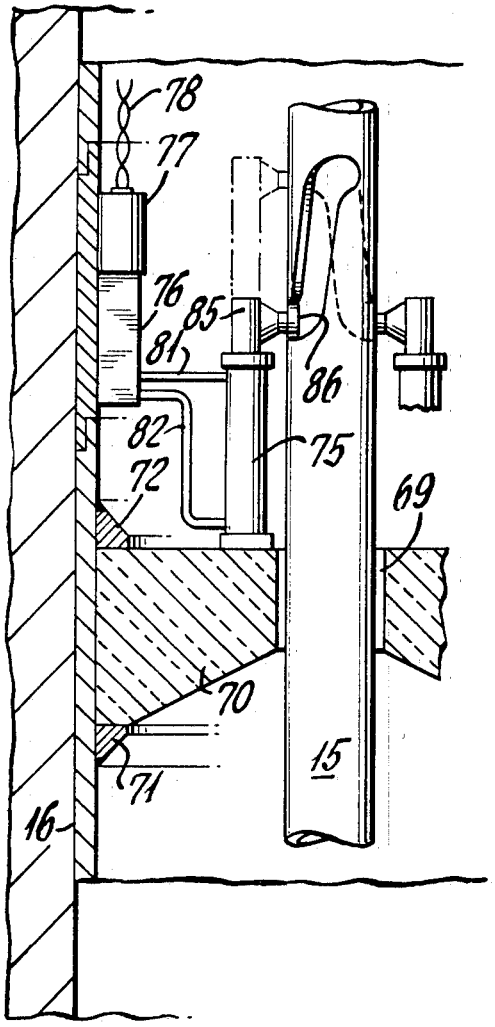
FIG. 8 is another enlarged schematic showing a portion of different apparatus which may be employed to cause rotation of the central conductor, in connection with removing swollen formation.

FIG. 8 illustrates apparatus which is employed in connection with providing axial rotation of the central conductor pipe 15. In this case there is a ceramic insulator member 70 that is securely attached to the coaxial conductor pipe 16. The member 70 is an electrical insulator and is annular in shape with a central opening 69 to permit the central conductor pipe 15 to pass therethrough. Member 70 is attached by means of a lower ring 71 and an upper ring 72 that are welded onto the outer conductor pipe 16. There is a relatively elongated cylinder 75 that is actuated by a hydraulic pump 76 driven by an electric motor 77. There is a pair of electric wires 78 that extend up to the surface for supplying the electric power to the motor 77.

Hydraulic cylinder 75 has the ends thereof connected to the hydraulic pump 76 by hydraulic lines 81 and 82, so that its piston 85 may be extended and retracted. There is a cam wheel 86 that is attached to the end of the piston 85. Cam wheel 86 reacts with a vertically oriented spiral groove 89 that is formed in the surface of the conductor pipe 15. It will be understood that the spiral groove 89 is so formed that when the piston 85 and its cam wheel 86 is extended upward it will cause rotation of the pipe 15 for substantially 90 degrees in axial rotation. The vertically extended position of the piston 85 is indicated in dashed lines.

It will be appreciated that the arrangement illustrated in FIG. 8 will have another cylinder and piston with cam wheel, on the opposite side of the conductor pipe 15 from cylinder and piston 75, 85 in order to counteract transverse forces on the pipe 15 and so confine the action to rotation about the axis of the pipe.

While the foregoing method and apparatus have been described above in considerable detail in accordance with the applicable statues, this is not be be taken as in any way limiting the invention but merely as being descriptive thereof.

We claim:

1. In radio frequency heating of oil shale or tar sand formations in situ wherein a central conductor and a coaxial shield are employed down hole, a method of combating the encroachment of said heated formation, comprising applying relative motion to said central conductor periodically for removing said encroaching formation.

2. Method according to claim 1, wherein said applying relative motion comprises moving said central conductor relative to said coaxial shield.

3. Method according to claim 2, wherein said central conductor moving comprises vertical oscillation.

4. Method according to claim 2, wherein said central conductor moving comprises axial rotation.

5. In radio frequency heating of oil shale or tar sand formations in situ, in combination with an applicator for electromagnetic propagation of radio frequency energy into said formation, said applicator comprising a central conductor extending a predetermined distance beyond the end of a coaxial shielding conductor, and a radio frequency generator for supplying said radio frequency energy to said applicator, the improvement comprising means associated with said central conductor for moving it relative to said formation whereby encroachment by said formation may be prevented.

6. The invention according to claim 5, wherein the improvement also comprises additional means associated with said central conductor for abrading said formation.

7. The invention according to claim 6, wherein said additional means comprises a protrusion on said central conductor.

8. The invention according to claim 7, wherein said protrusion comprises a chisel.

9. The invention according to claim 5, wherein the improvement also comprises first additonal means attached to said coaxial shielding conductor for cooperating with said central conductor, second additional means attached to said central conductor for cooperating with said coaxial shielding conductor, and third additional means for moving said central conductor relative to said coaxial shielding conductor.

10. The invention according to claim 9, wherein said third additional means comprises hydraulic means interconnecting said first additional means and said second additional means for moving said central conductor vertically.

11. The invention according to claim 9, wherein said third additional means comprises hydraulic means interconnecting said first additional means and said second additional means for moving said central conductor in axial rotation.

12. In radio frequency heating of oil shale or tar sand formations in situ, in combination with an applicator for electromagentic propagation of radio frequency energy into said formation, said applicator comprising a central steel pipe extending a predetermined distance beyond the end of a concentric steel pipe shielding conductor, and a radio frequency generator connected to said central steel pipe and to said concentric steel pipe for supplying said radio frequency to said applicator, the improvement comprising first annular electrically insulating means attached to the inside of said concentric steel pipe, second annular means integrally attached to the outside of said central steel pipe, and hydraulic cylinder and piston means interconnecting said first and second annular means for moving said central steel pipe vertically relative to said concentric steel pipe.

* * * * *